US005482106A

United States Patent [19]

Höffken et al.

[11] Patent Number: 5,482,106

[45] Date of Patent: Jan. 9, 1996

[54] PROCESS FOR THE CASTING OF METALS IN A CONTINUOUS CASTING INSTALLATION WITH CONTINUOUS STRAND WITHDRAWAL

[75] Inventors: Erich Höffken; Dieter Krüger, both of Dinslaken; Heinz Matten, Oberhausen; Günter Pietzko, Essen; Jürgen Scharlack, Duisburg, all of Germany

[73] Assignee: Thyssen Stahl AG, Duisberg, Germany

[21] Appl. No.: 286,986

[22] Filed: Aug. 6, 1994

Related U.S. Application Data

[63] Continuation of Ser. No. 972,284, Nov. 4, 1992, abandoned.

[30] Foreign Application Priority Data

Nov. 15, 1991 [DE] Germany ..... 41 37 588.2

[51] Int. Cl.[6] ..... B22D 11/16; B22D 11/20

[52] U.S. Cl. ..... 164/454; 164/154.5; 164/413

[58] Field of Search ..... 164/150.1, 151.2, 164/151.4, 151.5, 154.5, 454, 413

[56] References Cited

U.S. PATENT DOCUMENTS 4,615,375 10/1986 Bower ..... 164/451

FOREIGN PATENT DOCUMENTS 2501868 8/1978 Germany .

2923900 2/1981 Germany ..... 164/452

53-62733 6/1978 Japan ..... 164/452

62-286655 12/1987 Japan ..... 164/452

2247054 10/1990 Japan ..... 164/452

OTHER PUBLICATIONS

Experimental Methods for Engineers 4th Ed. J. P. Holman, Dec. 1984, pp. 384–395.

*Primary Examiner*—Kuang Y. Lin

*Attorney, Agent, or Firm*—Meltzer, Lippe, Goldstein et al.

[57] ABSTRACT

A process for continuous casting of a metal comprises continuously withdrawing a strand of the metal from a mold along a strand withdrawal direction, measuring the expansion of an inside wall of the mold along the strand withdrawal direction to obtain a component of inside wall expansion in the strand withdrawal direction due to mechanical forces exerted on the inside wall, and controlling the speed of withdrawal based on the component of inside wall expansion in the strand withdrawal direction due to mechanical forces. If the component of inside wall expansion of in the strand withdrawal direction due to mechanical forces exceeds certain limit values, the withdrawal step is slowed or interrupted, thereby eliminating break-outs due to cobbles. In an embodiment of the invention, expansion measurements are also taken along a direction transverse to the withdrawal direction, enabling the elimination of the component of expansion in the withdrawal direction due to heat.

8 Claims, 3 Drawing Sheets

PROCESS FOR THE CASTING OF METALS IN A CONTINUOUS CASTING INSTALLATION WITH CONTINUOUS STRAND WITHDRAWAL

This is a continuation of application Ser. No. 07/972,284, filed Nov. 4, 1992, and now abandoned.

BACKGROUND OF THE INVENTION

During casting in a continuous casting installation, liquid steel is cast from a distributor into a water-cooled, usually copper mould. During the continuous withdrawal of the strand from the mould, the mould is moved at a frequency of approximately 1 to 3 Hz in the strand withdrawal direction. As a rule a lubricating film is maintained between the steel and the inside of the mould wall. The cooling of the steel by the mould walls leads to the formation of a steel strand having solidified steel shells and a steel liquid core. The thus partially solidified steel strand is drawn by means of suitable withdrawal means from the mould, being at the same time supported and guided by rollers disposed below the mould.

In the practical operation of such a continuous casting installation from time to time unforeseeable malfunctions occur which sometimes result in liquid steel breaking through the solidified strand shell. Such breaches are attributed to cobbles (adhesion) between the steel and the cooled mould wall. Due to the withdrawal forces acting on the partially solidified strand, the strand shell is torn open in the zone of the cobbles. If then that place is not made strong enough again by cooling before leaving the mould, the liquid steel breaks through and flows into the installation. As a result, parts of the installation disposed below the mould, such as supporting and guide rollers and supporting constructions are often damaged to such an extent as to be no further use, and have to be replaced by new parts. This means that the installation has to be stopped, sometimes for days, with consequent loss of production. Continuous casting installation operators are therefore anxious to avoid such break-outs to the greatest possible extent.

For example, to prevent break-outs it has already been proposed to measure the changes in the withdrawal forces at the first segments of a strand guide adjoining the mould and to use the measured values to control the casting process. If given limit values are not reached, the casting process is slowed down or even interrupted (DE PS 29 23 900).

It is also known (DE PS 25 01 868) to monitor the distribution of the heat flux density on the mould wall during the casting process. The heat flux density is determined indirectly by measuring the expansion of the shaping mould wall at a number of portions thereof. The signals obtained are linked to one another in order to control in dependence thereon the strand withdrawal speed and the steel supply to the mould. That process does not relate, therefore, to the detection of cobbles preceding break-outs, but to the detection of the distribution of the heat flux density over the mould height, to enable the casting process to be controlled in dependence thereon.

In another prior art process (EP A3 0 389 139) the heat flux is determined at different heights of the mould, and the distance between the zone of maximum heat flux and the level of the bath of molten metal is used as a criterion to determine whether a break-out is starting.

The invention starts from a process for the casting of metals in a continuous casting installation, wherein the strand is continuously withdrawn from the mould and the casting process is controlled in dependence on stresses occurring in the continuous casting installation during the withdrawal of the strand.

It is an object of the invention to provide in such a process steps which enable strand break-outs to be avoided in a simple manner.

SUMMARY OF THE INVENTION

The solution of this problem in the aforementioned process consists in the feature that during continuous strand withdrawal a measurement is made of the expansion of the mould inside wall caused by the occurrence of mechanical forces in the strand withdrawal direction, and the measured values thus obtained are so used to control the casting process that the casting speed is reduced or the casting process interrupted when given limit values are not reached.

The process according to the invention is based on the knowledge that when withdrawing forces are acting on the strand and a cobble occurs, the mould wall briefly expands in the elastic range. This brief expansion, which is overlayered by the general thermal expansion of the mould wall, is an excellent signal of the occurrence of a break-out in the mould. In contrast with signals which are derived from changes in the temperature of the mould wall, this signal is generated without any delay, so that the steps for reducing the casting speed or even stopping the casting process can be taken quickly enough to prevent any outflow of liquid metal.

Using the process according to the invention it is also possible to distinguish between light and heavy cobbles. In the case of light cobbles it is enough so to reduce the casting speed that the remaining time in the mould is sufficient to enable a new, stable and solidified strand shell to develop by the continuation of cooling at the place of the break-out. Thereafter the casting speed can again be slowly and continuously increased. In contrast, in the case of heavy cobbles the casting process must be interrupted immediately, since with such cobbles the remaining time in the mould is insufficient to heal the break-out. Whether a cobble is to be regarded as light or heavy depends on the particular mould—i.e., mould-related limit values are given for comparison with the measured expansion signals. This comparison can be carried out with absolute values. However, it is also possible to compare the most recently detected measured value with a following measured value, so that the gradient can be measured and taken as a yardstick for an incipient break-out. Since in the case of a cobble the value based on said cobble increases very quickly in comparison with a value based on thermal expansion, said value is not falsified by the component from thermal expansion.

In the process according to the invention it is enough to measure expansion at one point on each mould wall. Any cobbles on the mould wall can be reliably determined in this manner. To enable even very small cobbles to be reliably detected, conventionally the expansion measurement is carried out not only in but also transversely of the strand withdrawal direction. The measuring points in and transversely of the strand withdrawal direction should be situated as close as possible to one another. By the linking of these two signals the component of expansion caused by heat can be eliminated, so that the signal obtained is determined exclusively by the brief expansion caused by the withdrawal forces in the case of a cobble. The linking of the signals for expansion in the strand withdrawal direction and transversely thereof can be carried out without heavy computation expenditure in a bridge circuit. Such a bridge circuit is not only simple in construction, but also insensitive to malfunctions.

Although in principle it is sufficient to carry out only one measurement on each mould wall, for safety reasons a number of measuring points should be provided, thus enabling a changeover to be made from one measuring point to another. It is in that case also possible to use all the measuring points simultaneously for the evaluation.

To correct errors resulting from thermal expansion in the measurement of expansion, it is not only possible to measure the gradient of the expansion, or the expansion in the strand withdrawal direction and also transversely thereof, but also to determine the temperature of the mould wall and, using known relations, to determine therefrom an expansion value which is so linked with the measured expansion value in the strand withdrawal direction that the value thus obtained is an unambiguous criterion for expansion in case of a cobble. Basically the expansion measurement can be carried out at any place on each mould wall. However, it has been found to be advantageous to perform the measurement not too close to the corners of the mould, since at that place due to the considerable rigidity of the construction the expansion of the mould wall is minimal. It is therefore advantageous for the measuring points to be situated in the central zone of the mould walls. They should be situated at at least one third of the width of the side wall in question away from the corners of the mould, and they should preferably be situated in the centre of the walls.

If the expansion measurement is carried out directly on the strand side parts of the mould walls, using suitable sensors, more particularly strain gauges, this means considerable expenditure, more particularly because of the supply lines to the sensors and lines disposed inside the water box. To avoid these problems, according to one feature of the invention the expansion measurement is carried out on the outside wall of the water box remote from the strand, if the water box forms a rigid unit with the mould inside wall.

BRIEF DESCRIPTION OF THE DRAWINGS

An embodiment of the invention will now be explained in greater detail with reference to the drawings, wherein.

DETAILED DESCRIPTION OF THE PREFERRED EMBODIMENTS

Figure 1:
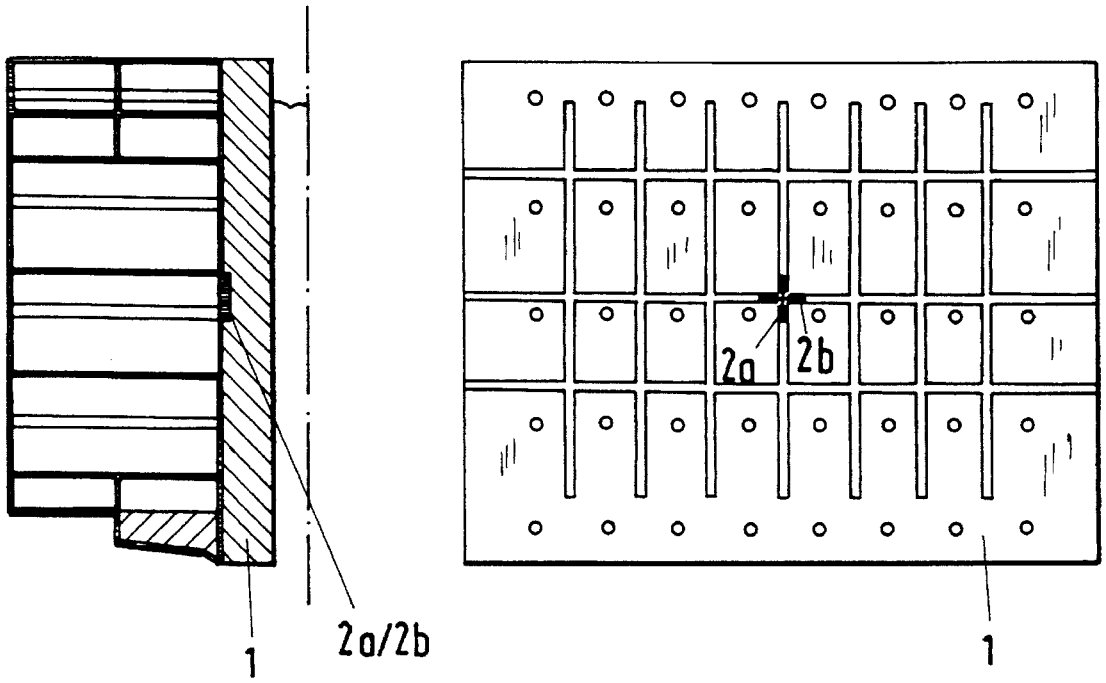
FIG. 1 shows the rear side of a strand side wall of a mould.
Figure 2:
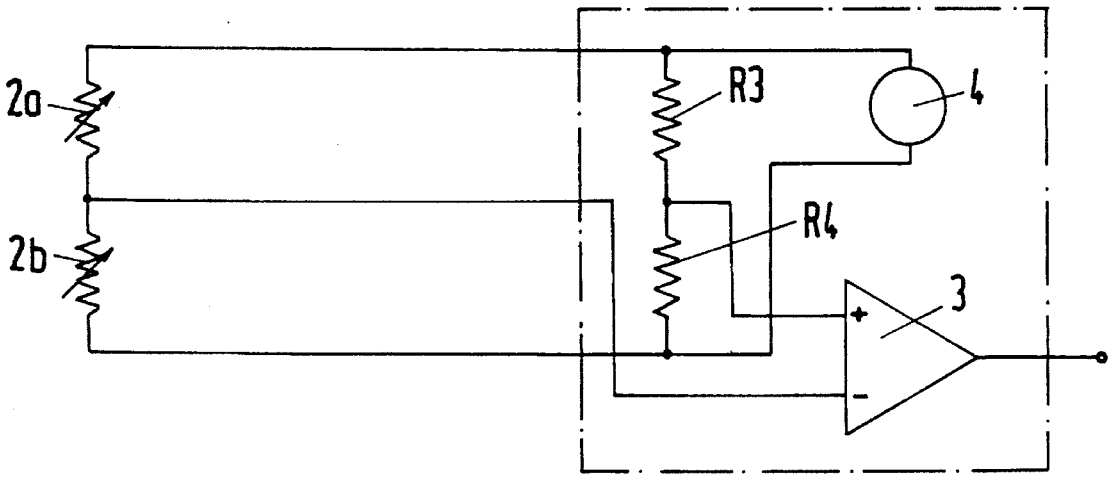
FIG. 2 shows a measuring arrangement using strain gauges.
Figure 3:
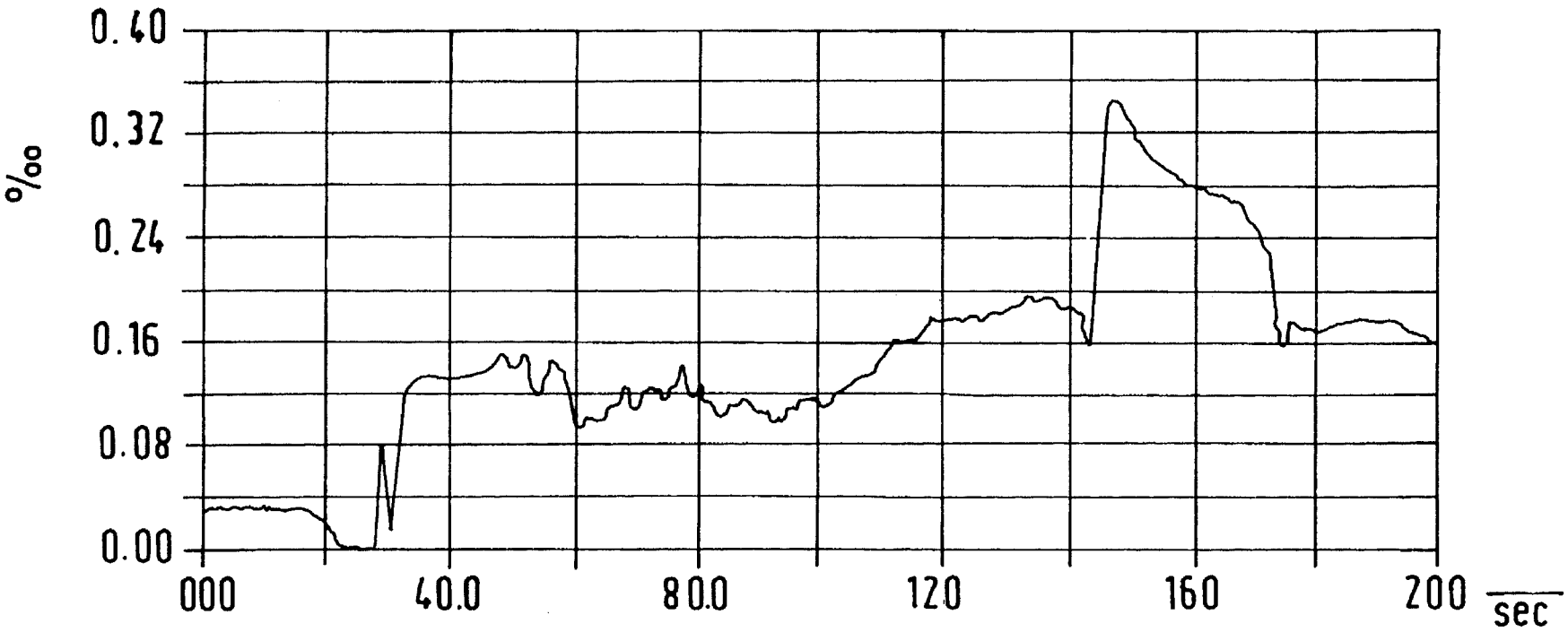
FIG. 3 is a graph showing the output signal of the measuring arrangement illustrated in FIG. 2.

Disposed in the centre on the rear side of a wide side wall 1 shown in FIG. 1 are two strain gauges 2*a*, 2*b*, one strain gauge 2*a* being disposed in the strand withdrawal direction and the other strain gauge 2*b* transversely thereof. The strain gauges 2*a*, 2*b* cooperate with two resistors R3, R4 to form a bridge circuit in whose diagonal an amplifier 3 is disposed which delivers an output signal. The bridge circuit, supplied from a voltage source 4, is so designed that the amplifier 3 delivers a small output signal, if any, when the resistance values of the strain gauges 2*a*, 2*b* are identical. This is always the case if, due to the absence of cobbles on the mould wall with effective withdrawal forces, only heat-conditioned expansions occur. In contrast, if a cobble occurs, the bridge circuit is detuned by an increase in the resistance value for the strain gauge 2*a*. In that case the amplifier 3 delivers a suddenly increasing output signal, as shown for the time between 140 and 150 sec in the expansion/time graph (FIG. 3). The suddenly increasing output signal is evaluated in an evaluating circuit. In dependence on the evaluation, the casting process is either slowed down or interrupted.

We claim:

1. A process for continuous casting of a metal, comprising, continuously withdrawing a strand of said metal from a mold along a strand withdrawal direction, measuring the expansion of an inside wall of said mold along said strand withdrawal direction, eliminating from the measurement of the expansion of said inside wall of said mold along said withdrawal direction a heat expansion component to obtain a component of the inside wall expansion in the stand withdrawal direction due to mechanical forces exerted on said inside wall, and controlling the speed of said withdrawal based on said component of the inside wall expansion in the strand withdrawal direction due to mechanical forces.

2. The process of claim 1, further comprising reducing the speed of said withdrawal when said component of the inside wall expansion in the strand withdrawal direction due to mechanical forces exceeds a first limit value.

3. The process of claim 2, further comprising interrupting said withdrawal when said component of the inside wall expansion in the strand withdrawal direction due to mechanical forces exceeds a second limit value.

4. The process of claim 1, further comprising measuring the expansion of said inside wall of said mold along a direction which is transverse to said strand withdrawal direction to obtain said heat expansion component.

5. The process of claim 4 wherein said measurements along said strand withdrawal direction and transverse to said strand withdrawal direction are carried out in closely adjoining locations.

6. The process of claim 5 wherein said expansion measurements are carried out in a central zone between corners of each inside wall of said mold.

7. The process of claim 6 wherein said expansion measurements are carried out at a plurality of places on each inside wall of said mold.

8. The process of claim 7 further comprising measuring the temperature of each inside wall at the location of said measurements, and taking said temperature into account in determining said component of the inside wall expansion in the strand withdrawal direction due to mechanical forces.

* * * * *